US006832642B2

(12) United States Patent
Titus et al.

(10) Patent No.: US 6,832,642 B2
(45) Date of Patent: Dec. 21, 2004

(54) WINDOW TREATMENT PANELS

(75) Inventors: Jodi R. Titus, Brooklyn, NY (US); Valborg F. Linn, New York, NY (US); Linda Johnson, Lloyd Harbor, NY (US); K. K. Agarwal, Ghazianad (IN)

(73) Assignee: Park B. Smith, Inc., New York, NY (US)

( * ) Notice: Subject to any disclaimer, the term of this patent is extended or adjusted under 35 U.S.C. 154(b) by 0 days.

(21) Appl. No.: 10/032,336

(22) Filed: Dec. 21, 2001

(65) Prior Publication Data

US 2003/0116288 A1 Jun. 26, 2003

(51) Int. Cl.[7] ..... E06B 9/56
(52) U.S. Cl. ..... 160/330; 160/348
(58) Field of Search ..... 160/38, 39, 330, 160/123, 124, 84.01, 348

(56) References Cited

U.S. PATENT DOCUMENTS

| | | | | | |
|---|---|---|---|---|---|
| 852,187 | A | | 4/1907 | Luft | |
| 1,778,499 | A | * | 10/1930 | King | 160/124 |
| 2,611,428 | A | | 9/1952 | Van Cleeff | 160/349 |
| 2,627,918 | A | * | 2/1953 | Gordon | 160/348 |
| 2,668,587 | A | | 2/1954 | London et al. | 160/349 |
| 2,671,508 | A | * | 3/1954 | Gordon | 160/348 |
| 2,779,405 | A | | 1/1957 | Hess | 160/348 |
| 2,840,155 | A | | 6/1958 | Stern | 160/124 |
| 2,952,315 | A | * | 9/1960 | Brontman | 160/330 |
| 3,160,202 | A | | 12/1964 | Rosen | |
| 3,322,182 | A | | 5/1967 | Palella | |
| 3,487,875 | A | | 1/1970 | Shukat et al. | 160/84 |
| 3,754,589 | A | | 8/1973 | Helmberg et al. | 160/349 |
| 3,777,800 | A | | 12/1973 | Susoev | 160/84 |
| 3,952,788 | A | | 4/1976 | Scholer | 160/84 |
| 3,952,988 | A | | 4/1976 | Easterly | 248/441 |
| 3,999,590 | A | * | 12/1976 | Koch | 160/348 X |

(List continued on next page.)

*Primary Examiner*—David Purol
(74) *Attorney, Agent, or Firm*—Alston & Bird LLP

(57) ABSTRACT

A window treatment sized to fit substantially over a window opening is disclosed. The window treatment comprises a row of buttons positioned along an upper portion of the window treatment. The window treatment also comprises one or more rows of loops extending horizontally along the surface of the window treatment. Any row of loops can be removably secured to the row of buttons to enable at least a portion of the window treatment to be raised while it is positioned over the window opening. The engagement of the buttons and loops is the only means by which the window treatment is removably secured in a raised position.

24 Claims, 4 Drawing Sheets

U.S. PATENT DOCUMENTS

| | | | | | |
|---|---|---|---|---|---|
| 4,069,857 | A | | 1/1978 | Brookshire | 160/84 |
| D256,536 | S | | 8/1980 | Atkins | D6/208.1 |
| D277,061 | S | | 1/1985 | Picoy | D6/575 |
| D295,354 | S | | 4/1988 | De Block et al. | D6/577 |
| 4,739,815 | A | | 4/1988 | Altman | 160/84 |
| 4,877,075 | A | | 10/1989 | Markowitz | 160/84 |
| 4,909,297 | A | | 3/1990 | Koller et al. | 160/84.1 |
| 4,921,032 | A | * | 5/1990 | May | 160/348 X |
| 4,928,743 | A | | 5/1990 | Wojtysiak | 160/84.1 |
| 4,934,435 | A | | 6/1990 | Regev | 160/84.1 |
| 4,976,301 | A | | 12/1990 | Easley et al. | 160/84.1 |
| 4,986,329 | A | * | 1/1991 | Kupchunos | 160/330 X |
| 5,010,944 | A | * | 4/1991 | Bussert | 160/84.01 |
| D320,127 | S | | 9/1991 | Schopp | D6/575 |
| D348,371 | S | | 7/1994 | Judkins | D6/577 |
| D371,711 | S | | 7/1996 | Clark | D6/575 |
| D371,928 | S | | 7/1996 | Evjy | D6/575 |
| 5,566,734 | A | | 10/1996 | Levy et al. | 160/84.01 |
| 5,566,735 | A | | 10/1996 | Jelic | 160/84.04 |
| 5,649,583 | A | | 7/1997 | Hsu | 160/84.05 |
| D393,560 | S | | 4/1998 | Adams | D6/575 |
| 5,738,159 | A | * | 4/1998 | O'Brien | 160/84.01 |
| 5,894,876 | A | | 4/1999 | O'Brien | 160/84.01 |
| D415,382 | S | | 10/1999 | Walker | D6/575 |
| D415,644 | S | | 10/1999 | Goodwin | D6/575 |
| D415,645 | S | | 10/1999 | Goodwin | D6/575 |
| 6,041,454 | A | | 3/2000 | Summerford | 4/558 |
| D426,738 | S | | 6/2000 | Goodwin | D6/576 |
| 6,142,210 | A | | 11/2000 | Isoda | 160/124 |
| D440,093 | S | | 4/2001 | Siegel et al. | D6/575 |
| D440,094 | S | | 4/2001 | Shen | D6/575 |
| D445,621 | S | | 7/2001 | Judkins | D6/575 |
| D446,070 | S | | 8/2001 | Judkins | D6/575 |
| 6,431,245 | B1 | | 8/2002 | Shen | 160/84.03 |
| 6,497,264 | B1 | | 12/2002 | Paskevicius | 160/84.03 |
| D468,950 | S | | 1/2003 | Judkins | D6/575 |
| 6,520,238 | B2 | | 2/2003 | Allsopp | 160/84.04 |
| D473,743 | S | | 4/2003 | Judkins | D6/575 |
| 6,543,516 | B2 | | 4/2003 | Hwan | 160/84.01 |
| 2003/0051831 | A1 | | 3/2003 | Bouldin | 160/348 |

* cited by examiner

WINDOW TREATMENT PANELS

BACKGROUND OF THE INVENTION

Windows such as those which are found in residential settings are typically provided with window treatments. The term window treatment is used herein to include curtains, drapes, fabric panels, blinds and valences. Any type of drapery fabric, curtain fabric, wood, metal, jute, bamboo or other natural or man-made material may be used to make the window treatment of the invention.

The primary function of a window treatment is to restrict the amount of light and visual access through windows but the aesthetic result is considered by most purchasers as being the primary basis for selection of one of a plurality of competing styles. Once a particular style is chosen it is usually not possible to vary the visual effect that a particular style provides when the window treatment is placed in front of a window. Examples of several prior art window treatments are found in U.S. Pat. No. 2,668,587; U.S. Pat. No. 2,611,428; U.S. Pat. No. 6,142,210 and U.S. Pat. No. 3,952,988.

Generally, window treatments are cut to provide various visual effects in that when the window treatment is placed in position in front of a window, the window is "framed" by the profile of the window treatment. The visual effect of a particular window treatment may only be modified by using cloth tie backs or means which allow for the horizontally movement of the window treatment such as movable suspending means or traverse rods.

The applicants have devised a window treatment system which has a plurality of fastening means that are arranged to allow for the partial or complete raising of the window treatment. This structure allows the user to select a number of positions which vary the exposure of the window to admit varying amounts of light or visual access to the window opening without having to remove the window treatment from its fixed position in front of a window.

SUMMARY OF THE INVENTION

The invention provides a window treatment which is sized to fit substantially over a window opening, said window treatment having one or more loop means which are affixed to said window treatment in order to allow a lower portion of said window treatment to be raised vertically and affixed to a surface of said window treatment to expose a portion of the surface of said window opening. Generally there will be one row of button means and from 1 to 7, preferably 3 to 5 rows of loop means. The button means and loop means are intended to hold a lower portion of the window treatment to an upper portion of the window treatment.

Accordingly, it is a primary object of this invention to provide a window treatment that can be arranged in different configurations when it is hung in front of a window.

It is also an object of the invention to provide a window treatment that can be arranged in many configurations to provide different visual impressions.

It is also an object of the invention to provide a window treatment which may be easily opened and closed to act as a privacy closure for a window as well as a decorative window treatment.

It is also an object of the invention to provide a window treatment that provides at least two distinct visual impressions by means of button means and loop means that may be used to vary the area of the window opening that is exposed on the inside of the window.

These and other objects of the invention will become apparent from a review of the specification.

DETAILED DESCRIPTION OF THE INVENTION

Figure 1:
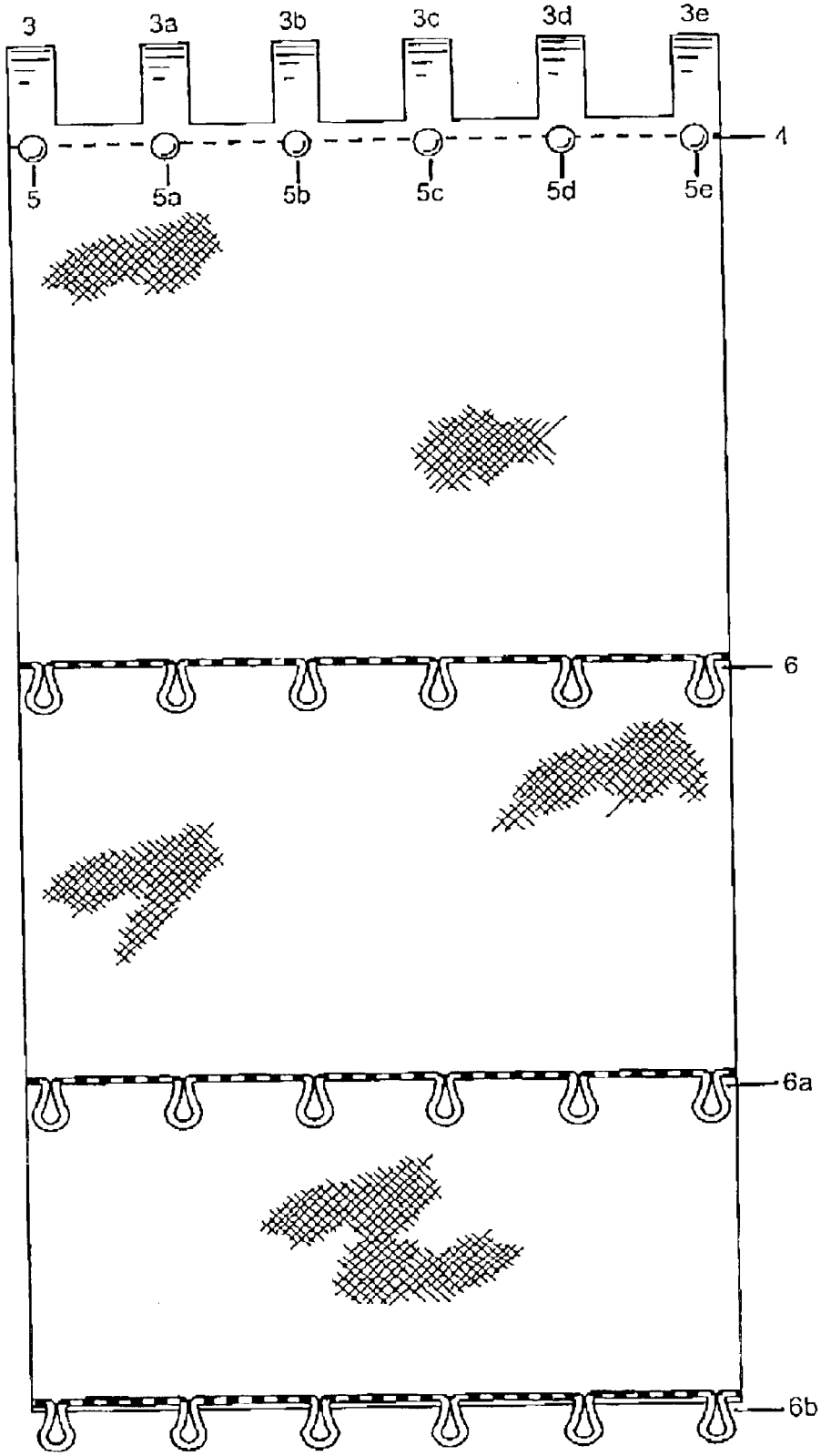
FIG. 1 is a front plan view of a fabric panel having tab tops, a horizontal row of button means and the horizontal rows of loop means.

FIG. 1 discloses an embodiment of a fabric panel 2 having tab tops 3, 3*a*, 3*b*, 3*c*, 3*d* and 3*e* having interacting means which comprise button row 4 and loop rows 6, 6*a* and 6*b*. The buttons 5, 5*a*, 5*b*, 5*c*, 5*d* and 5*e* are spaced at substantially equal intervals in a horizontal direction across the fabric panel 2.

The loop rows 6, 6*a* and 6*b* are spaced at gradually increasing intervals from the bottom of the fabric panel to the top of the fabric panel in order to provide substantially equal amounts of exposed fabric 10, 12 on the hidden panels 14, 16 which are under folded sections 18 and 20 when the rows of loops 6, 6*a* and 6*b* are all fastened to the button means 5, 5*a*, 5*c*, 5*d* and 5*e*. Front sections 18, 20 and 22 result from the folding of the fabric panel to allow for fastening of the loops onto the button means.

Figure 2:
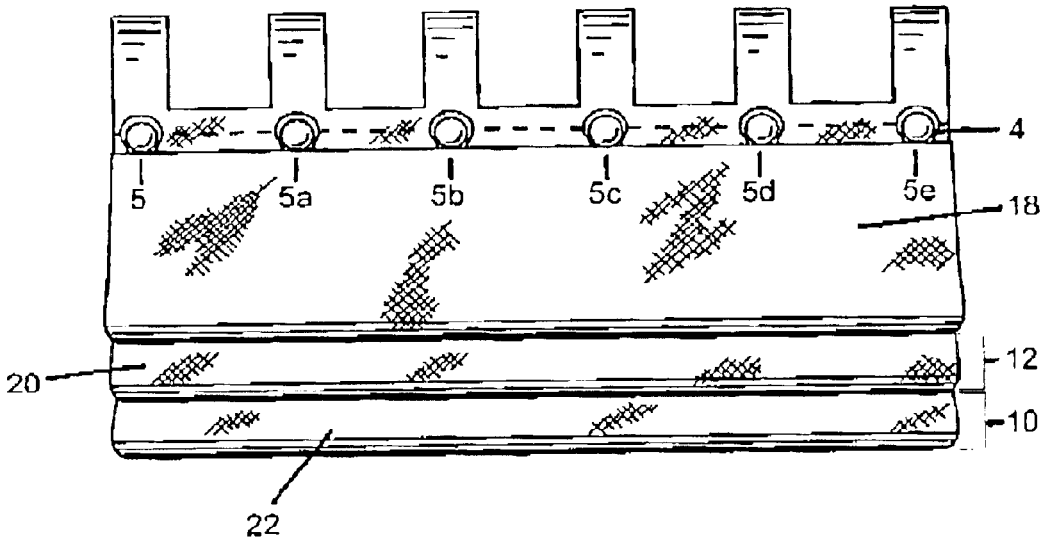
FIG. 2 is a front view of the fabric panel of FIG. 1 where the three rows of loops have been fastened seriatim onto the button means.

As best seen in FIG. 2, when all of the loops in rows 6, 6*a* and 6*b* are fastened sequentially with the highest row being fastened first and the lowest row being fastened last to the button means the fabric panel presents a series of folded edges 10, 12 which provide an aesthetically pleasing front and side profiles to the viewer. At the same time, the buttons and loops function to provide a secure means of holding the fabric panel in one or more open positions that may be used for control of the amount of light that is allowed to pass through the window.

If desired, the fabrics may be printed in such a manner that a preselected design may be formed when the window treatment is placed in the "button up" position.

The embodiment of FIG. 1 is shown with a tab top suspending means but any other type of ring or rod type suspending sleeve may be used to provide a means for suspending the window treatments of the invention.

The button means may comprise any type of a protrusion such as a post, button, knob, curved hook, Velcro etc. that is capable of holding a fabric or rope type loop means such as, or a loop of roping or thread, a metal ring, snaps, button holes or Velcro type of fastening system. The button means and the loop means are sized to allow for quick engagement and disengagement of the button means in order to facilitate the operation of the window treatment. While it is preferred to place the button means and loop means as shown in FIG. 1, it is possible to reverse the positions of the button means and the loop means so that rows of button means are available to be affixed to a single row of loop means located at the upper part of the window treatment.

Figure 3:
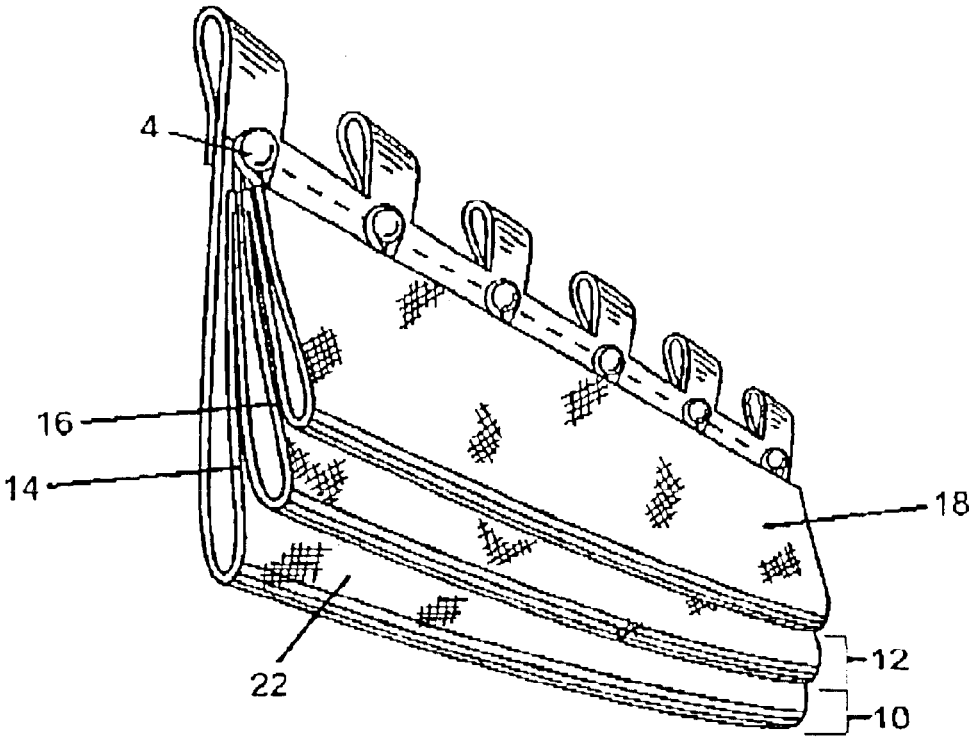
FIG. 3 is a perspective view of FIG. 2 which shows the folded edges of the fabric panel when the rows of loops are attached to the button means.
Figure 4:
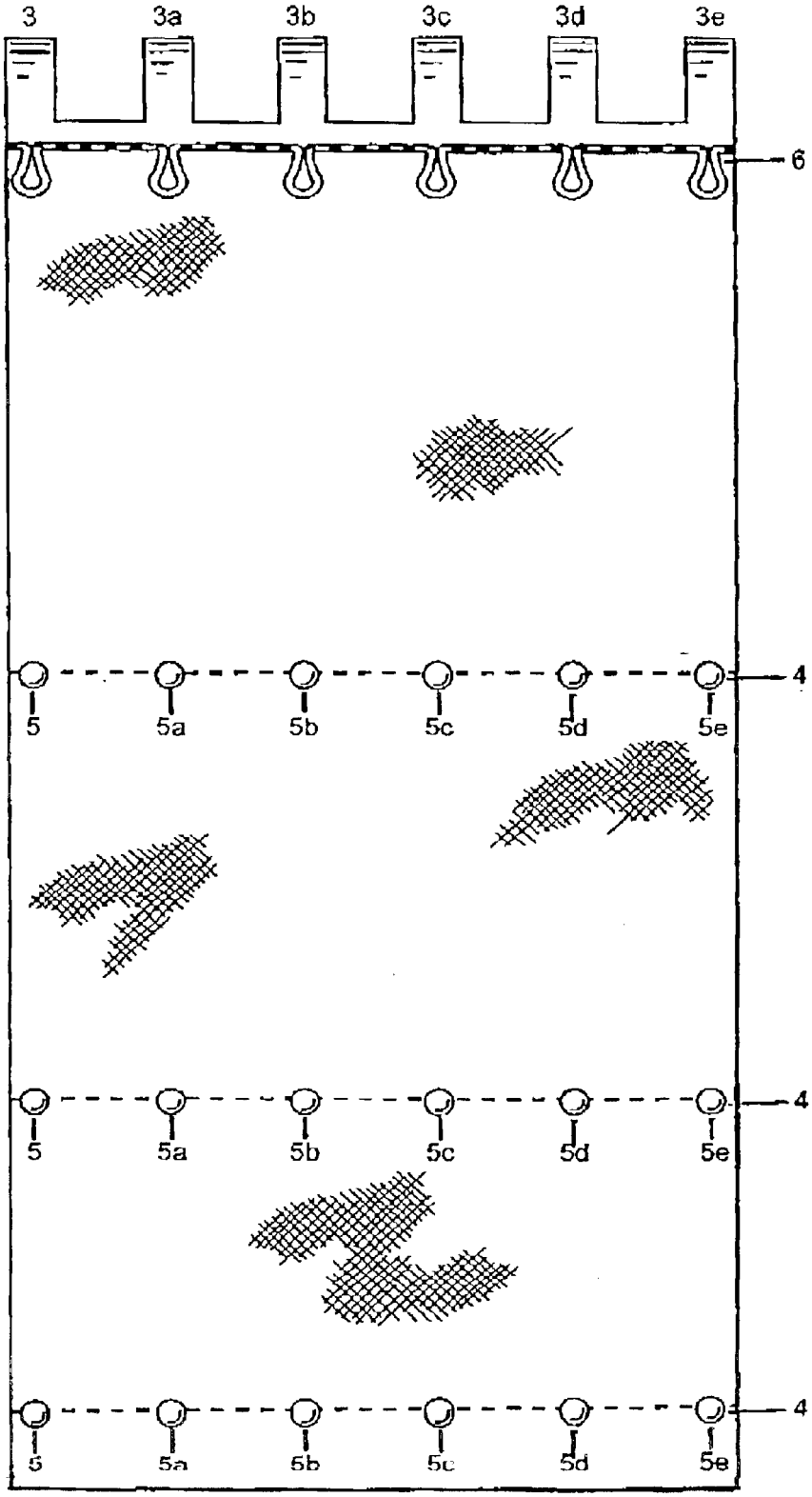
FIG. 4 is a front view of a fabric panel comprising a row of Loops and three rows of buttons.

The rows of button means and loop means may be spaced as shown in FIG. 3 or in any type of spacing to achieve any desired effect. The rows of button means and loop means are shown in a horizontal arrangement but it is within the scope of the invention to arrange the rows of button means and loop means in various angled or arced configurations to achieve any desired visual effect. Each row of button means and loop means may comprise from 3 to 10, preferably 4 to 8 button means and loop means, depending on the weight of the fabric, the width of the panel and the visual effect that is desired.

The present invention also includes a window treatment sized to fit over a window opening. The window treatment having one or more rows of button means affixed to the window treatment and which allow a lower portion of the window treatment to be raised vertically and affixed by loop means to a surface of the window treatment.

It is preferred to use one row of buttons arranged horizontally at a location which is within 0–12 inches, preferably within four inches of the top edge of the means which are used to suspend the panel in front of the window.

The foregoing description of a preferred embodiment of the invention has been presented for purposes of illustration and description. It is not intended to be exhaustive or to limit the invention precise form disclosed. Obvious modifications or variations are possible in light of the above teachings. All such obvious modifications and variations are intended to be within the scope of the appended claims.

We claim:

1. A raisable window treatment sized to fit substantially over a window opening, the window treatment capable of being raised or lowered without the use of draw stings, the window treatment comprising:

(i) three to five rows of buttons horizontally positioned along the window treatment; each row of buttons is spaced apart from the other rows of buttons;

(ii) a row of loops extending horizontally along the window treatment:

(iii) each row of buttons adapted for fastening onto the row of loops for removably securing at least a lower portion of the window treatment in a raised position while the window treatment is positioned over the window opening;

(iv) a suspending sleeve for receiving a rod therethrough to suspend the window treatment over the window opening; the suspending sleeve is positioned along a top portion of the window treatment;

(v) the window treatment is in a raised position when at least one row of buttons is fastened to the row of loops, thereby causing a portion of the window treatment to be removably secured in the raised position while the window treatment is positioned over the window opening; and (vi) the fastening of at least one row of buttons onto the row of loops is the only means by which the window treatment is removably secured in a raised position while the window treatment is positioned over the window opening.

2. A raisable window treatment sized to fit substantially over a window opening, the window treatment capable of being raised or lowered without the use of draw stings, the window treatment comprising:

(i) Three to five rows of loops horizontally positioned along the window treatment; each row of loops spaced apart from the other rows of loops;

(ii) a row of buttons extending horizontally along the window treatment;

(iii) each row of loops adapted for fastening onto the row of buttons for removably securing at least a lower portion of the window treatment in a raised position while the window treatment is positioned over the window opening;

(iv) a suspending sleeve for receiving a rod therethrough to suspend the window treatment over the window opening; the suspending sleeve is positioned along a top portion of the window treatment;

(v) the window treatment is in a raised position when at least one row of loops is fastened onto the row of buttons, thereby causing a portion of lower portion of the window treatment to be removably secured in the raised position while the window treatment is positioned over the window opening; and (vi) the fastening of the row of buttons to at least one row of loops is the only means by which the window treatment is removably secured in a raised position while the window treatment is positioned over the window opening.

3. A raisable window treatment sized to fit substantially over a window opening, the window treatment capable of being raised or lowered without the use of draw strings, the window treatment comprising:

(i) a fabric panel; the fabric panel having a first face and second face;

(ii) a row of loops and three to five rows of buttons; the loops in the row of loops are adapted for fastening onto the buttons in the three to five rows of buttons for removably securing at least a portion of the window treatment in a raised position while the window treatment is positioned over the window opening;

(iii) the row of loops extending horizontally along the first face of the fabric panel; the three to five rows of buttons extending horizontally along the first face of the fabric panel;

(iv) a suspending sleeve for receiving a rod therethrough to suspend the window treatment over the window opening; the suspending sleeve is positioned along a top portion of the window treatment;

(v) the window treatment is in a raised position when at least one row of buttons is fastened to the row of loops, thereby causing a lower portion of the window treatment to be removably secured in the raised position while the window treatment is positioned over the window opening; and (vi) the fastening of the at least one row of buttons to the the row of loops is the only means by which the window treatment is removably secured in a raised position while the window treatment is positioned over the window opening.

4. The window treatment of claim 2, wherein the row of buttons is ranged horizontally at a location which is about 0 to about 12 inches from a top edge of the window treatment.

5. The window treatment of claim 1 or 3, wherein the window treatment comprises three rows of buttons; the three rows of buttons are positioned to permit the lower portion of the window treatment to be raised at least at three different lengths when the first, second or third row of buttons is fastened to the row of loops.

6. The window treatment of claim 2, wherein the window treatment comprises three rows of loops, the three rows of loops are positioned to permit the lower portion of the window treatment to be raised at least at three different lengths when the first, second or third row of loops is fastened to the row of buttons.

7. A raisable window treatment sized to fit substantially over a window opening, the window treatment capable of being raised or lowered without the use of draw strings, the window treatment comprising:

(i) a row of buttons and at least one row of loops for removably securing at least a portion of the window treatment in a raised position while the window treatment is positioned over the window opening;

(ii) the row of buttons is affixed to the window treatment along an upper portion of the window treatment;

(iii) the at least one row of loops is positioned along a lower portion of the window treatment;

(iv) the loops in the at least one row of loops are adapted for fastening onto the buttons in the row of buttons;

(v) the window treatment is in a raised position when the row of buttons is fastened onto at least one row of loops, thereby causing the lower portion of the window treatment to be removably secured in the raised position while the window treatment is positioned over the window opening; and (vi) the fastening of the row of buttons onto at least one row of loops is the only means by which the lower portion of the window treatment is removably secured in a raised position while the window treatment is positioned over the window opening.

8. The window treatment of claim 7, wherein the row of buttons is arranged horizontally at a location which is about 0 to about 12 inches from the top edge of the window treatment.

9. The window treatment of claim 7, further comprising a suspending sleeve for receiving a rod therethrough to suspend the window treatment over the window opening; the suspending sleeve is positioned along the top of the window treatment.

10. The window treatment of claim 7, further comprising multiple rows of loops; the multiple rows of loops are horizontally spaced relative to each other.

11. A raisable window treatment sized to fit substantially over a window opening, the window treatment capable of being raised or lowered without the use of draw strings, the window treatment comprising;

(i) a row of loops and at least one row of buttons for removably securing at least a portion of the window treatment in a raised position while the window treatment is positioned over the window opening;

(ii) the row of loops is affixed to the window treatment along an upper portion of the window treatment;

(iii) the at least one row of buttons is positioned along a lower portion of the window treatment;

(iv) the loops in the row of loops are adapted for fastening onto the buttons in the at least one row of buttons;

(v) the window treatment is in a raised position when at least one row of buttons is fastened onto the row of loops, thereby causing the lower portion of the window treatment to be removably secured in the raised position while the window treatment is positioned over the window opening; and (vi) the fastening of the at least one row of buttons onto the row of loops is the only means by which the lower portion of the window treatment is removably secured in a raised position while the window treatment is positioned over the window opening.

12. A raisable window treatment sized to fit substantially over a window opening, the window treatment capable of being raised or lowered without the use of draw strings, the window treatment comprising:

(i) a row of buttons and three rows of loops for removably securing at least a portion of the window treatment in a raised position white the window treatment is positioned over the window opening;

(ii) the row of buttons is affixed to the window treatment along an upper portion of the window treatment; the row of buttons extending horizontally across to upper portion of the window treatment;

(iii) the three rows of loops are positioned below the row of buttons; each row of loops extends horizontally across the window treatment, and each row of loops is spaced apart from the other rows of loops;

(iv) the loops in each row of loops is adapted for fastening onto the buttons in the row of buttons thereto;

(v) the window treatment is in a raised position when the row of buttons is fastened onto at least one row of loops, thereby causing a lower portion of the window treatment to be removably secured in the raised position while the window treatment is positioned over the window opening; and (vi) the fastening of the row of buttons onto at least one row of loops is the only means by which the lower portion of the window treatment is removably secured in a raised position while the window treatment is positioned over the window opening.

13. A raisable window treatment sized to fit substantially over a window opening the window treatment capable of being raised or lowered without the use of draw strings, the window treatment comprising:

(i) a row of loops and three rows of buttons for removably securing at least a portion of the window treatment in a raised position while the window treatment is positioned over the window opening;

(ii) the row of loops is affixed to the window treatment along an upper portion of the window treatment; the row of loops extending horizontally across the window treatment;

(iii) the three rows of buttons are positioned below the row of loops; each row of buttons extending horizontally across the window treatment and each row of buttons is spaced apart from the other row of buttons;

(iv) the loops in the rows of loops are adapted far fastening onto the buttons in the row of buttons;

(v) the window treatment is in a raised position when the first, second or third row of buttons is fastened to the row of loops, thereby causing a lower portion of the window treatment to be removably secured in the raised position while the window treatment is positioned over the window opening; and (vi) the fastening of the first, second or third row of buttons to the row of loops is the only means by which the lower portion of the window treatment is removably secured in a raised position while the window treatment is positioned over the window opening.

14. The window treatment of claim 12, wherein the row of buttons is arranged horizontally at a location which is about 0 to about 12 inches from the top edge of the window treatment.

15. The window treatment of claim 7, 11, 12 or 13, further comprising a tab top suspending sleeve for suspending the window treatment in front of the window opening.

16. The window treatment of claim 12, further comprising a suspending sleeve for receiving a rod therethrough to suspend the window treatment over the window opening; the suspending sleeve is positioned along the top of the window treatment.

17. The window treatment of claim 13, further comprising a suspending sleeve for receiving a rod therethrough to suspend the window treatment over the window opening; the suspending sleeve is positioned along the top of the window treatment.

18. The window treatment of claim 12, wherein the three rows of loops horizontally spaced relative to each other.

19. The window treatment of claim 12, wherein the three rows of loops are positioned to permit the portion of the window treatment to be raised at least at three different lengths when the first, second or third row of buttons is fastened to the row of loops.

20. The window treatment of claim 13, wherein the three rows of buttons are positioned along the window treatment to permit the portion of the window treatment to be raised at least at three different lengths when the first, second or third row of buttons is fastened to the row of loops.

21. A raisable window treatment sized to fit substantially over a window opening, the window treatment capable of being raised or lowered without the use of draw strings, the window treatment comprising:

(i) three to five rows of buttons horizontally positioned along the window treatment; each row of buttons is spaced apart from the other rows of buttons;

(ii) a row of loops extending horizontally along the window treatment;

(iii) each row of buttons adapted for fastening onto the row of loops for removably securing at least a lower portion of the window treatment in a raised position while the window treatment is positioned over the window opening;

(iv) a tab top suspending sleeve for receiving a rod therethrough to suspend the window treatment over the window opening; the tab top suspending sleeve is positioned along a top portion of the window treatment;

(v) the window treatment is in a raised position when at least one row of buttons is fastened to the row of loops, thereby causing a portion of the window treatment to be removably secured in the raised position while the window treatment is positioned over the window opening; and (vi) the fastening of at least one row of buttons onto the row of loops is the only means by which the window treatment is removably seemed in a raised position while the window treatment is positioned over the window opening.

22. A raisable window treatment sized to fit substantially over a window opening, the window treatment capable of being raised or lowered without the use of draw strings, the window treatment comprising:

(i) a fabric panel; the fabric panel having a first face and second face;

(ii) a row of loops and three to five rows of buttons; the loops in the rows of loops are adapted for fastening onto the buttons in the three to five rows of buttons for removably securing at least a portion of the window treatment in a raised position while the window treatment is positioned over the window opening;

(iii) the rows of loops extending horizontally along the first face of the fabric panel; the three to five rows of buttons extending horizontally along die first face of the fabric panel;

(iv) a tab top suspending sleeve for receiving a rod therethrough to suspend the window treatment over the window opening; the tab tap suspending sleeve is positioned along a top portion of the window treatment;

(v) the window treatment is in a raised position when at least one row of buttons is fastened to the row of loops, thereby causing a lower portion of the window treatment to be removably secured in the raised position while the window treatment is positioned over the window opening; and (vi) the fastening of the at least one row of buttons to the one row of loops is the only means by which the window treatment is removably secured in a raised position while the window treatment is positioned over the window opening.

23. A raisable window treatment sized to fit substantially over a window opening, the window treatment capable of being raised or lowered without the use of draw strings, the window treatment comprising:

(i) three to five rows of loops horizontally positioned along the window treatment; each row of loops spaced apart from the other rows of loops;

(ii) a row of buttons extending horizontally along the window treatment;

(iii) each row of loops adapted for fastening onto the row of buttons for removably securing at least a lower portion of the window treatment in a raised position while the window treatment is positioned over the window opening;

(iv) a tab top suspending sleeve for receiving a rod therethrough to suspend the window treatment over the window opening; the tab top suspending sleeve is positioned along a top portion of the window treatment;

(v) the window treatment is in a raised position when at least one row of loops is fastened onto the row of buttons, thereby causing a portion of lower portion of the window treatment to be removably secured in the raised position while the window treatment is positioned over the window opening; and (vi) the fastening of the row of buttons to the row of loops is the only means by which the window treatment is removably secured in a raised position while the window treatment is positioned over the window opening.

24. The window treatment of claim 1, 2 or 3, wherein the suspending sleeve is a tab top.

* * * * *

UNITED STATES PATENT AND TRADEMARK OFFICE

CERTIFICATE OF CORRECTION

PATENT NO. : 6,832,642 B2
DATED : December 21, 2004
INVENTOR(S) : Titus et al.

It is certified that error appears in the above-identified patent and that said Letters Patent is hereby corrected as shown below:

Column 4,
Line 54, "ranged" should read -- arranged --.

Column 6,
Line 7, "to" should read -- the --.
Line 27, "opening" should read -- opening,--.
Line 42, "far" should read -- for --.

Column 7,
Line 45, "seemed" should read -- secured --.

Signed and Sealed this

Fourteenth Day of June, 2005

JON W. DUDAS
*Director of the United States Patent and Trademark Office*